US010685618B2

(12) United States Patent
Koo et al.

(10) Patent No.: US 10,685,618 B2
(45) Date of Patent: Jun. 16, 2020

(54) GATE DRIVING CIRCUIT AND DISPLAY DEVICE HAVING THE SAME

(71) Applicant: Samsung Display Co., Ltd., Yongin-Si, Gyeonggi-Do (KR)

(72) Inventors: Jahun Koo, Asan-si (KR); Haksun Kim, Seoul (KR); Kyung-hun Lee, Yongin-si (KR); Ho Lee, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 166 days.

(21) Appl. No.: 15/829,007

(22) Filed: Dec. 1, 2017

(65) Prior Publication Data

US 2018/0158432 A1 Jun. 7, 2018

(30) Foreign Application Priority Data

Dec. 5, 2016 (KR) ..... 10-2016-0164511

(51) Int. Cl.

| | |
|---|---|
| ***G09G 3/36*** | (2006.01) |
| ***G09G 3/3291*** | (2016.01) |
| ***G09G 5/00*** | (2006.01) |

(52) U.S. Cl.

CPC ..... *G09G 3/3696* (2013.01); *G09G 3/3291* (2013.01); *G09G 3/3648* (2013.01); *G09G 3/3677* (2013.01); *G09G 5/003* (2013.01); *G09G 2310/0286* (2013.01); *G09G 2310/06* (2013.01); *G09G 2310/066* (2013.01)

(58) Field of Classification Search

CPC .. G09G 3/3696; G09G 3/3648; G09G 3/3266; G09G 3/3674; G09G 3/3291; G09G 5/003

See application file for complete search history.

(56) References Cited

U.S. PATENT DOCUMENTS

| | | | | |
|---|---|---|---|---|
| 5,986,631 | A | 11/1999 | Nanno et al. | |
| 8,786,538 | B2 * | 7/2014 | Byun | G09G 3/3677 345/100 |
| 9,607,553 | B2 | 3/2017 | Park | |
| 9,728,152 | B2 * | 8/2017 | Jo | G09G 3/3677 |
| 10,163,392 | B2 * | 12/2018 | Imai | G09G 3/3225 |
| 2006/0012587 | A1 * | 1/2006 | Stevenson | G09G 3/3233 345/204 |

(Continued)

FOREIGN PATENT DOCUMENTS

| | | | |
|---|---|---|---|
| KR | 1020150076028 | A | 7/2015 |
| KR | 1020160113416 | A | 9/2016 |
| KR | 1020170035404 | A | 3/2017 |

*Primary Examiner* — Sardis F Azongha

(74) *Attorney, Agent, or Firm* — Cantor Colburn LLP

(57) ABSTRACT

A display device includes a display panel which includes a plurality of gate lines and a plurality of pixels, where each of the pixels is connected to a corresponding gate line among the gate lines, and a gate driving circuit which includes a stage that applies a gate signal to at least one of the gate lines. The gate signal includes a high period in which the gate signal has a high voltage and a low period in which the gate signal has a low voltage having a level less than a level of the high voltage, and the low period includes a falling period in which the low voltage falls to a second level from a first level which is greater than the second level.

18 Claims, 13 Drawing Sheets

(56) References Cited

U.S. PATENT DOCUMENTS

| | | | | |
|---|---|---|---|---|
| 2010/0097368 | A1* | 4/2010 | Hwang | G09G 3/3677 345/213 |
| 2011/0012891 | A1* | 1/2011 | Cheng | G09G 3/3677 345/214 |
| 2014/0055436 | A1* | 2/2014 | Han | G09G 3/3696 345/211 |
| 2016/0275903 | A1 | 9/2016 | Park et al. | |
| 2017/0084245 | A1 | 3/2017 | Hwang et al. | |

* cited by examiner

GATE DRIVING CIRCUIT AND DISPLAY DEVICE HAVING THE SAME

This application claims priority to Korean Patent Application No. 10-2016-0164511, filed on Dec. 5, 2016, and all the benefits accruing therefrom under 35 U.S.C. § 119, the content of which in its entirety is hereby incorporated by reference.

BACKGROUND

1. Field of Disclosure

Exemplary embodiments of the invention relate to a gate driving circuit and a display device having the same. More particularly, the invention relates to a gate driving circuit capable of compensating for deterioration of transistors included in a display panel and a display device having the gate driving circuit.

2. Description of the Related Art

A display device includes plural gate lines, plural data lines, and plural pixels connected to the gate lines and the data lines. The display device includes a gate driving circuit that sequentially applies gate signals to the gate lines and a data driving circuit that applies data signals to the data lines.

The gate driving circuit may include one shift register including plural stages connected to one after another. Each of the stages may include plural transistors connected to each other organically to output a gate voltage to a corresponding gate line among the gate lines.

Transistors included in a pixel of the display panel are burnt and deteriorated by a voltage continuously applied thereto.

SUMMARY

Exemplary embodiments of the invention are directed to a gate driving circuit capable of compensating for deterioration of transistors in a pixel, which is caused by a voltage applied to the transistors from the gate driving circuit.

Exemplary embodiments of the invention direct to a display device including the gate driving circuit.

According to an exemplary embodiment, a display device includes a display panel which includes a plurality of gate lines and a plurality of pixels, where each of the pixels is connected to a corresponding gate line among the gate lines, and a gate driving circuit which includes a stage that applies a gate signal to at least one of the gate lines. The gate signal includes a high period in which the gate signal has a high voltage and a low period in which the gate signal has a low voltage having a level less than a level of the high voltage, and the low period includes a first period in which the low voltage falls to a second level from a first level which is greater than the second level.

In an exemplary embodiment, tach of the pixels may include a pixel transistor which outputs a pixel voltage in response to the gate signal and a liquid crystal capacitor charged with the pixel voltage.

In an exemplary embodiment, the pixel transistor may include a control electrode to which the gate signal is applied, an insulating layer which covers the control electrode, an active layer disposed on the insulating layer, an input electrode to which a voltage corresponding to the pixel voltage is applied, and an output electrode from which the pixel voltage is output. The input electrode may be disposed on the active layer and the output electrode may be disposed on the active layer. Electrons trapped in the insulating layer may be de-trapped in the first period.

In an exemplary embodiment, the first level may be from about −15 volts to about −5 volts, and the second level may be from about −35 volts to about −14 volts.

In an exemplary embodiment, the high voltage may be from about 14 volts to about 35 volts.

In an exemplary embodiment, the display device may further include a data driving circuit which outputs a data signal corresponding to the pixel voltage.

In an exemplary embodiment, in a case that the gate driving circuit and the display panel are turned on after being turned off, the low period may include the first period in which the low voltage gradually falls to the second level from the first level.

In an exemplary embodiment, in a case that the gate driving circuit and the display panel are turned on after being turned off, the gate signal may comprise the low period and the high period again.

In an exemplary embodiment, the stage may include an output part which is turned on or off in response to a voltage of a Q-node and outputs the gate signal to a gate output terminal of the stage, a control part which controls the voltage of the Q-node, and a pull-down part which applies the low voltage to the gate output terminal after the high period.

In an exemplary embodiment, the low period may further include a constant period in which the level of the low voltage is constant.

In an exemplary embodiment, the low period may further include a second period in which the level of the low voltage gradually rises.

In an exemplary embodiment, the display panel may display an effective image during frame periods and display a blank image during a blank period defined between the frame periods, and the level of the low voltage in the blank period may be less than the level of the low voltage in the frame periods.

According to an exemplary embodiment of the inventive concept, a gate driving circuit includes a gate output terminal electrically connected to a gate line, a control part which controls a voltage of a Q-node, a first output part which is turned on or off in response to the voltage of the Q-node and outputs a gate-on signal to the gate output terminal, and a first pull-down part which applies a gate-off signal, which comprises a period in which a voltage decreases to a second level from a first level which is greater than the second level, to the gate output terminal after the gate-on signal is output from the first output part.

According to an exemplary embodiments of the inventive concept, a display device includes a display panel which includes a plurality of gate lines, a plurality of data lines, and a plurality of pixels, where each of the pixels is connected to a corresponding gate line among the gate lines and a corresponding data line among the data lines, a data driving circuit which applies a data signal to at least one of the data lines, and a gate driving circuit which applies a gate signal to at least one of the gate lines.

The gate driving circuit includes a gate output terminal electrically connected to one of the gate lines, a control part which controls a voltage of a Q-node, a first output part which is turned on or off in response to the voltage of the Q-node and outputs a gate-on signal to the gate output terminal, and a first pull-down part which applies a gate-off signal, in which a voltage decreases to a second level from a first level which is greater than the second level, to the gate output terminal after the gate-on signal is output from the first output part.

According to the above, the transistors included in the pixel may be prevented from burning and deteriorating due to the trap of carriers.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
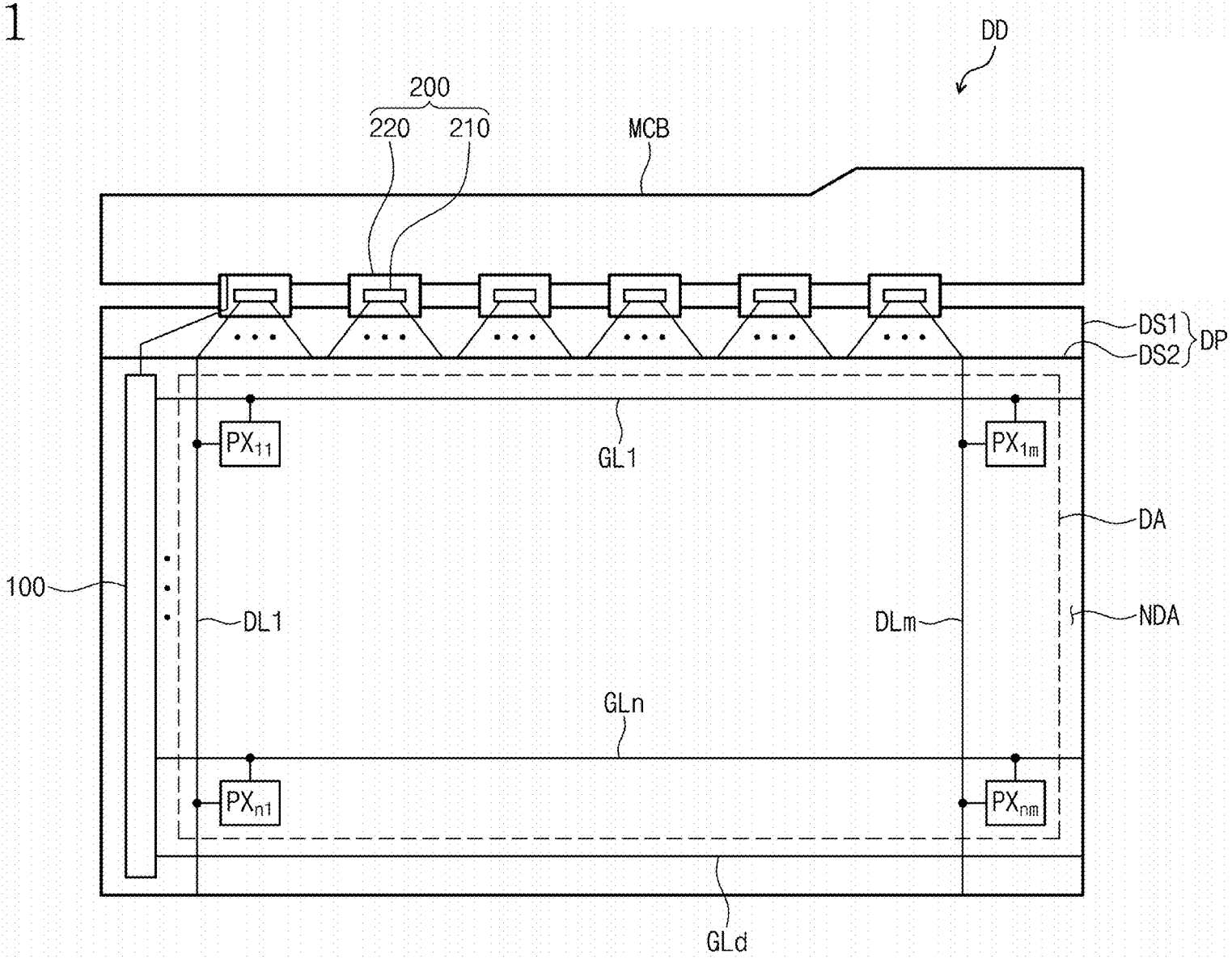
FIG. 1 is a plan view showing an exemplary embodiment of a display device according to the invention.

The following description with reference to the accompanying drawings is provided to assist in a comprehensive understanding of various exemplary embodiments of the invention as defined by the claims and their equivalents, it includes various specific details to assist in that understanding but these are to be regarded as merely exemplary. Accordingly, those of ordinary skill in the art will recognize that various changes and modifications of the various exemplary embodiments described herein can be made without departing from the scope and spirit of the invention.

Like numerals refer to like elements throughout. In the drawings, the thickness of layers, films, and regions are exaggerated for clarity. The use of the terms first, second, etc. do not denote any order or importance, but rather the terms first, second, etc. are used to distinguish one element from another. Thus, a first element, component, region, layer or section discussed below could be termed a second element, component, region, layer or section without departing from the teachings of the invention. It is to be understood that the singular forms "a," "an," and "the" include plural referents unless the context clearly dictates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Hereinafter, the invention will be explained in detail with reference to the accompanying drawings.

Figure 2:
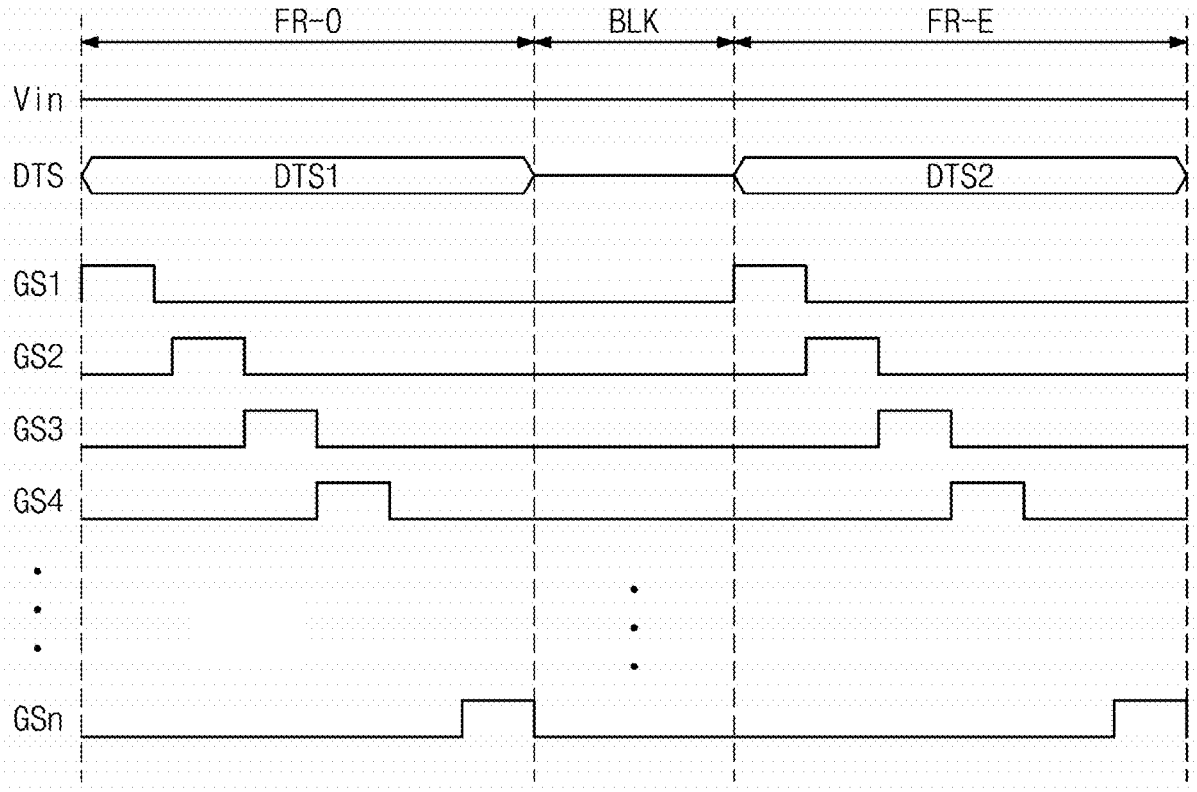
FIG. 2 is a timing diagram showing an exemplary embodiment of signals of a display device according to the invention.

FIG. 1 is a plan view showing an exemplary embodiment of a display device DD according to the invention. FIG. 2 is a timing diagram showing an exemplary embodiment of signals of a display device DD according to the invention.

Referring to FIG. 1, the display device DD may include a display panel DP, a gate driving circuit 100, a data driving circuit 200, and a main circuit board MCB.

The display panel DP may be a liquid crystal display panel, an organic light emitting display panel, an electrophoretic display panel, or an electrowetting display panel, but the invention should not be limited thereto or thereby. In this exemplary embodiment, the liquid crystal display panel will be described as the display panel DP. In addition, a liquid crystal display including the liquid crystal display panel may further include a polarizer, a backlight unit, and the like.

The display panel DP may include a first substrate DS1, a second substrate DS2 spaced apart from the first substrate DS1, and a liquid crystal layer (not shown) disposed between the first substrate DS1 and the second substrate DS2. In a plan view, the display panel DP includes a display area DA in which a plurality of pixels $PX_{11}$ to $PX_{nm}$ is arranged and a non-display area NDA surrounding the display area DA. Here, "n" and "m" are natural numbers.

The display panel DP may include a plurality of gate lines GL1 to GLn disposed on the first substrate DS1 and a plurality of data lines DL1 to DLm disposed on the first substrate DS1 to cross the gate lines GL1 to GLn. The gate lines GL1 to GLn are connected to the gate driving circuit 100. The data lines DL1 to DLm are connected to the data driving circuit 200. FIG. 1 shows some gate lines among the gate lines GL1 to GLn and some data lines among the data lines DL1 to DLm as an example. In addition, the display panel DP may further include a dummy gate line GLd disposed in the non-display area NDA of the first substrate DS1. The dummy gate line GLd may be provided in a plural number.

FIG. 1 shows some exemplary pixels among the pixels $PX_{11}$ to $PX_{nm}$. Each of the pixels $PX_{11}$ to $PX_{nm}$ is connected to a corresponding gate line among the gate lines GL1 to GLn and a corresponding data line among the data lines DL1 to DLm. However, the dummy gate line GLd is not connected to the pixels $PX_{11}$ to $PX_{nm}$.

The pixels $PX_{11}$ to $PX_{nm}$ may be grouped into plural groups depending on a color displayed thereby. Each of the pixels $PX_{11}$ to $PX_{nm}$ displays one of primary colors. The primary colors may include red, green, blue, and white colors, but the invention should not be limited thereto or thereby. That is, the primary colors may further include various colors, such as yellow, cyan, magenta, etc.

The gate driving circuit 100 and the data driving circuit 200 receive a control signal from a signal controller (not shown), e.g., a timing controller. The signal controller may be mounted on the main circuit board MCB. The signal controller may receive image data and a control signal from an external graphic controller (not shown).

The gate driving circuit 100 generates gate signals GS1 to GSn based on the control signal (hereinafter, referred to as a "gate control signal") provided from the signal controller during frame periods FR-O and FR-E and outputs the gate signals GS1 to GSn to the gate lines GL1 to GLn, respectively. The gate signals GS1 to GSn may be sequentially output.

The gate driving circuit 100 may be substantially simultaneously formed together with the pixels $PX_{11}$ to $PX_{nm}$ through a thin film process. For instance, the gate driving circuit 100 may be mounted on the non-display area NDA in an amorphous silicon TFT gate driver circuit ("ASG") form or an oxide semiconductor TFT gate driver circuit ("OSG") form. The gate driving circuit 100 includes a plurality of driving transistors TRG (refer FIG. 6).

FIG. 1 shows a display device DD including one gate driving circuit 100 connected to left ends of the gate lines GL1 to GLn as a representative example. Although not shown in figures, alternatively, the display device DD may include two gate driving circuits. In this case, one gate driving circuit of the two gate driving circuits may be connected to the left ends of the gate lines GL1 to GLn, and the other gate driving circuit of the two gate driving circuits may be connected to right ends of the gate lines GL1 to GLn. In addition, one of the two gate driving circuits may be connected to odd-numbered gate lines of the gate lines GL1 to GLn, and the other of the two gate driving circuits may be connected to even-numbered gate lines of the gate lines GL1 to GLn.

The data driving circuit 200 generates grayscale voltages corresponding to the image data provided from the signal controller based on the control signal (hereinafter, referred to as a "data control signal") received from the signal controller. The data driving circuit 200 outputs the grayscale voltages to the data lines DL1 to DLm as a data signal DTS.

The data signal DTS may include positive polarity data voltages having a positive value with respect to a common voltage and/or negative polarity data voltages having a negative value with respect to the common voltage. Some data voltages of the data voltages applied to the data lines DL1 to DLm have the positive polarity, and the other data voltages of the data voltages applied to the data lines DL1 to DLm have the negative polarity. The polarity of the data signal DTS may be inverted according to frame periods FR-O and FR-E to prevent liquid crystals from burning and deteriorating. The data driving circuit 200 may generate the data voltages, which are reversed in their polarity in every frame period unit, in response to an inversion signal.

The data driving circuit 200 includes a driving chip 210 and a flexible circuit board 220 on which the driving chip 210 is mounted. Each of the driving chip 210 and the flexible circuit board 220 may be provided in a plural number. The flexible circuit board 220 may electrically connect the main circuit board MCB to the first substrate DS1. Each of the driving chips 210 provides a corresponding data voltage of the data voltages to a corresponding data line of the data lines DL1 to DLm.

In FIG. 1, the data driving circuit 200 is provided in a tape carrier package ("TCP") form, but the invention should not be limited thereto or thereby. That is, the data driving circuit 200 may be mounted on the non-display area NDA of the first substrate DS1 in a chip-on-glass ("COG") form.

Referring to FIG. 2, the frame periods FR-O and FR-E are defined as periods during which an effective image is displayed. The frame periods FR-O and FR-E may be divided into an odd-numbered frame period FR-O and an even-numbered frame period FR-E.

The data signal DTS is output to the data lines DL1 to DLm during the frame periods FR-O and FR-E. The data signal DTS may be divided into a first data signal DTS1 and a second data signal DTS2 according to the frame periods.

The first data signal DTS1 is output to the data lines DL1 to DLm during the odd-numbered frame period FR-O, and the second data signal DTS2 is output to the data lines DL1 to DLm during the even-numbered frame period FR-E.

A blank period BLK is defined as a period in which a blank image is displayed. The blank period BLK may be defined between the frame periods FR-O and FR-E, i.e., between the odd-numbered frame period FR-O and the even-numbered frame period FR-E. In another exemplary embodiment of the invention, the blank period BLK may be defined as a period in which no image is displayed.

In addition, the blank period BLK may further include a period before the effective image is displayed and after the display device DD is turned on. Further, the blank period BLK may further include a period before the display device DD is turned off and after the effective image is displayed.

The gate signals GS1 to GSn may be sequentially output, however, the output of the gate signals GS1 to GSn according to the invention should not be limited thereto or thereby. The gate signals GS1 to GSn may be sequentially output with a predetermined phase difference.

A period in which each of the gate signals GS1 to GSn is output once corresponds to one of the frame periods FR-O and FR-E. That is, during each of the frame periods FR-O and FR-E, each of the gate signals GS1 to GSn is output one time.

FIG. 2 schematically shows a high period in which the gate signals GS1 to GSn have a high level voltage and a low period in which the gate signals GS1 to GSn have a low level voltage, and a variation of the voltage in each period is not shown. The variation of the voltage in the high and low periods will be described later.

Figure 3:
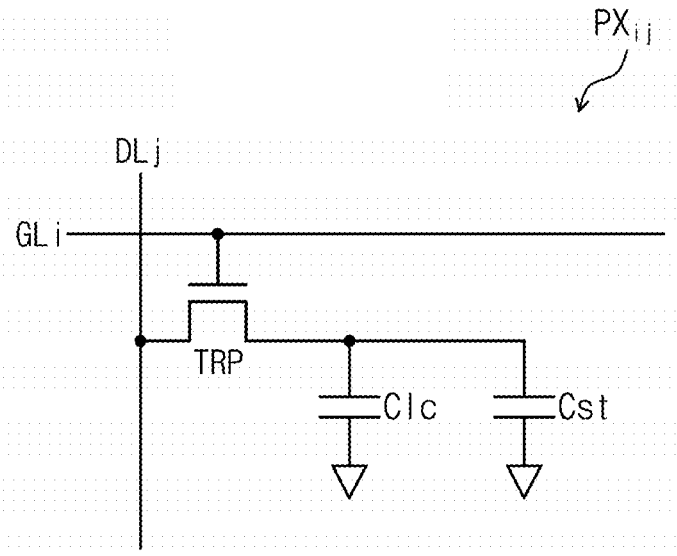
FIG. 3 is an equivalent circuit diagram showing an exemplary embodiment of a pixel according to the invention.
Figure 4:
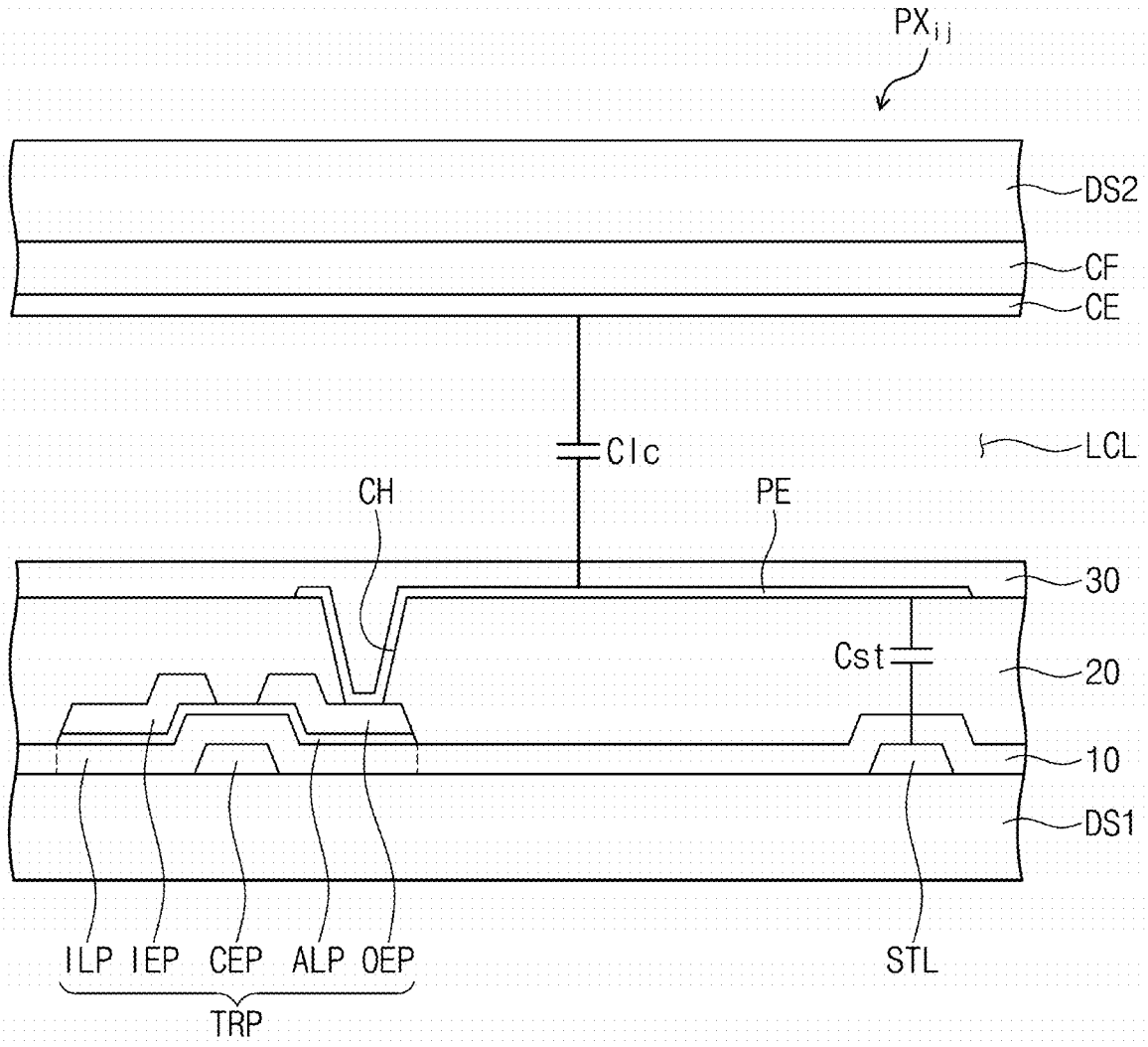
FIG. 4 is a cross-sectional view showing an exemplary embodiment of a pixel according to the invention.

FIG. 3 is an equivalent circuit diagram showing an exemplary embodiment of a pixel $PX_{ij}$ according to the invention. FIG. 4 is a cross-sectional view showing an exemplary embodiment of a pixel $PX_{ij}$ according to the invention. Each of the pixels $PX_{11}$ to $PX_{nm}$ shown in FIG. 1 may have the equivalent circuit shown in FIG. 3.

Referring to FIG. 3, the pixel $PX_{ij}$ includes a pixel thin film transistor TRP (hereinafter, referred to as a "pixel transistor"), a liquid crystal capacitor Clc, and a storage capacitor Cst. In an exemplary embodiment, the storage capacitor Cst may be omitted.

The pixel transistor TRP is electrically connected to an i-th gate line GLi and a j-th data line DLj. The pixel transistor TRP outputs a pixel voltage corresponding to the data signal provided from the j-th data line DLj in response to the gate signal provided from the i-th gate line GLi.

The liquid crystal capacitor Clc is charged with the pixel voltage provided from the pixel transistor TRP. An alignment of liquid crystal directors included in the liquid crystal layer LCL (refer to FIG. 4) is changed in accordance with an amount of electric charges charged in the liquid crystal capacitor Clc. A light incident to the liquid crystal layer transmits through thereof or is blocked depending on the alignment of the liquid crystal directors.

The storage capacitor Cst is connected to the liquid crystal capacitor Clc in parallel. The storage capacitor Cst maintains the alignment of the liquid crystal directors for a predetermined period.

Referring to FIG. 4, the pixel transistor TRP includes a control electrode CEP (hereinafter, referred to as a "pixel control electrode") connected to the i-th gate line GLi (refer to FIG. 2), an active layer ALP (hereinafter, referred to as a "pixel active layer") overlapped with the pixel control electrode CEP, an insulating layer ILP covering the pixel active layer ALP, an input electrode IEP (hereinafter, referred to as a "pixel input electrode") connected to the j-th data line DLj (refer to FIG. 2), and an output electrode OEP (hereinafter, referred to as a "pixel output electrode") disposed to be spaced apart from the pixel input electrode IEP.

The liquid crystal capacitor Clc includes a pixel electrode PE and a common electrode CE. The storage capacitor Cst includes the pixel electrode PE and a portion of a storage line STL overlapped with the pixel electrode PE.

The i-th gate line GLi and the storage line STL may be disposed on a surface of the first substrate DS1. The pixel control electrode CEP is branched from the i-th gate line GLi. In an exemplary embodiment, the i-th gate line GLi and the storage line STL include a metal material, such as aluminum (Al), silver (Ag), copper (Cu), molybdenum (Mo), chromium (Cr), tantalum (Ta), titanium (Ti), or an alloy thereof. Each of the i-th gate line GLi and the storage line STL may have a multi-layer structure, for example, a structure including an titanium layer and a copper layer.

A first insulating layer 10 is disposed on the first substrate DS1 to cover the pixel control electrode CEP and the storage line STL. The insulating layer ILP of the pixel transistor TRP corresponds to a portion of the first insulating layer 10. The first insulating layer 10 includes at least one of an inorganic material and an organic material. The first insulating layer 10 is an organic or inorganic layer. In an exemplary embodiment, the first insulating layer 10 may have a multi-layer structure, for example, a structure including a silicon nitride layer and a silicon oxide layer.

The pixel active layer ALP is disposed on the first insulating layer 10 to overlap with the pixel control electrode CEP. The pixel active layer ALP includes a semiconductor layer (not shown) and an ohmic contact layer (not shown).

The pixel active layer ALP includes amorphous silicon or polysilicon. In addition, the pixel active layer ALP may include a metal oxide semiconductor.

The pixel output electrode OEP and the pixel input electrode IEP are disposed on the pixel active layer ALP. The pixel output electrode OEP and the pixel input electrode IEP are disposed to be spaced apart from each other. Each of the pixel output electrode OEP and the pixel input electrode IEP partially overlaps with the pixel control electrode CEP.

FIG. 4 shows the pixel transistor TRP having a staggered structure, but the structure of the pixel transistor TRP according to the invention should not be limited to the staggered structure. That is, the pixel transistor TRP may have a planar structure.

A second insulating layer 20 is disposed on the first insulating layer 10 to cover the pixel active layer ALP, the pixel output electrode OEP, and the pixel input electrode IEP. The second insulating layer 20 provides an even top surface. The second insulating layer 20 may include an organic material.

The pixel electrode PE is disposed on the second insulating layer 20. The pixel electrode PE is connected to the pixel output electrode OEP through a contact hole CH defined through the second insulating layer 20. An alignment layer 30 is disposed on the second insulating layer 20 to cover the pixel electrode PE.

A color filter layer CF is disposed on a surface of the second substrate DS2. The common electrode CE is disposed on the color filter layer CF. The common electrode CE is applied with a common voltage. The common voltage has a level different from that of the pixel voltage. An alignment layer (not shown) may be disposed on the common electrode CE to cover the common electrode CE. Another insulating layer (not shown) may be disposed between the color filter layer CF and the common electrode CE.

The pixel electrode PE and the common electrode CE face each other such that the liquid crystal layer LCL is disposed between the pixel electrode PE and the common electrode CE, and the pixel electrode PE, the common electrode CE and the liquid crystal layer LCL form the liquid crystal capacitor Clc. In addition, the pixel electrode PE and the portion of the storage line STL face each other such that the first and second insulating layers 10 and 20 are disposed between the pixel electrode PE and the portion of the storage line STL, and the pixel electrode PE, the portion of the storage line STL and the first and second insulating layers 10 and 20 form the storage capacitor Cst. The storage line STL receives a storage voltage having a level different from that of the pixel voltage. The storage voltage may have the same level as that of the common voltage.

FIG. 4 shows a cross-section of the pixel $PX_{ij}$ as a representative example. In another exemplary embodiment, different from the structure of the pixel $PX_{ij}$ shown in FIG. 4, at least one of the color filter layer CF and the common electrode CE may be disposed on the first substrate DS1 rather than the second substrate DS2. The liquid crystal display panel according to an exemplary embodiment may include a vertical alignment ("VA") mode pixel, a patterned vertical alignment ("PVA") mode pixel, an in-plane switching ("IPS") mode pixel, a fringe-field switching ("FFS") mode pixel, or a plane-to-line switching ("PLS") mode pixel.

Figure 5:
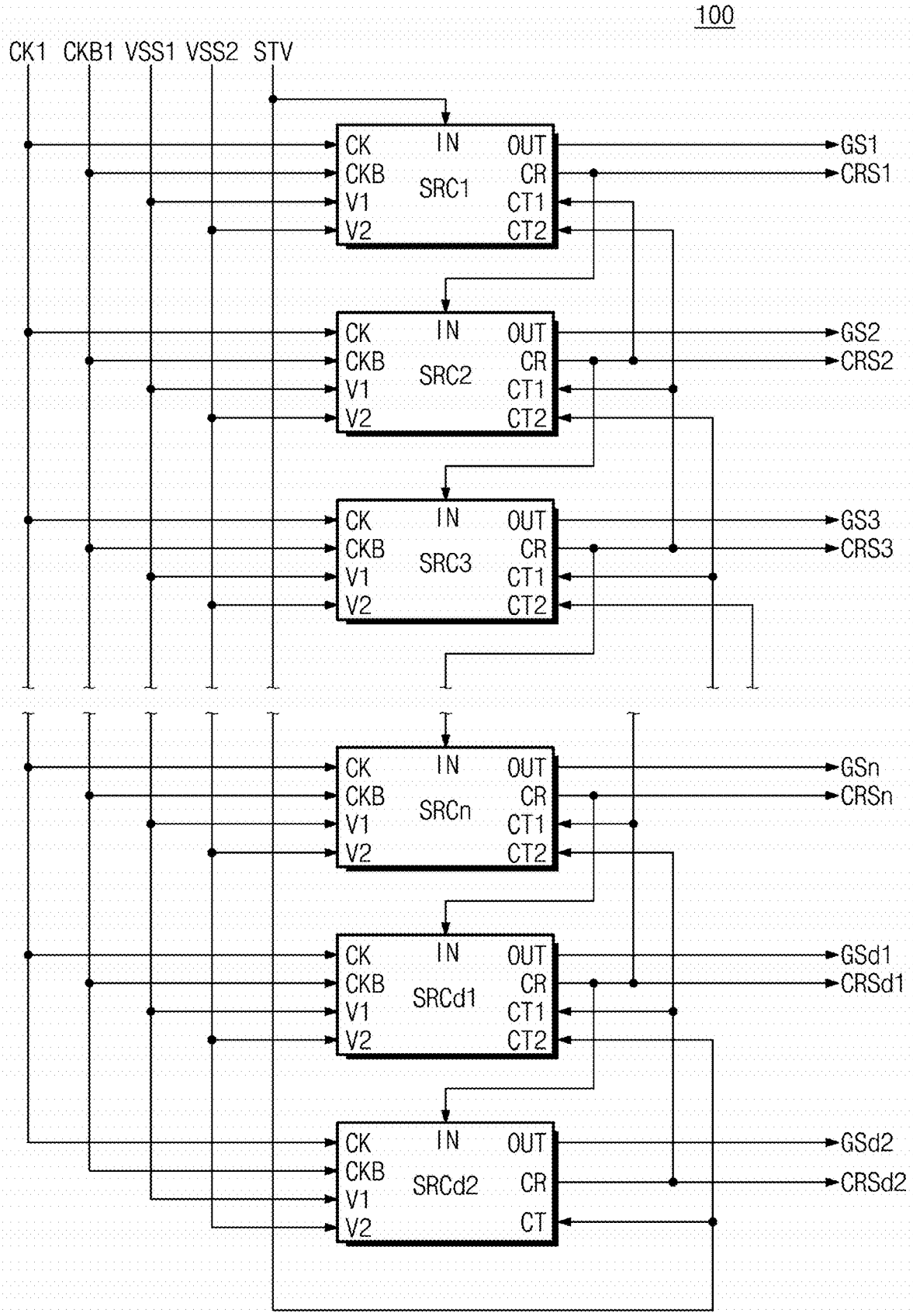
FIG. 5 is a block diagram showing an exemplary embodiment of a gate driving circuit according to the invention.

FIG. 5 is a block diagram showing an exemplary embodiment of the gate driving circuit 100 according to the invention.

Referring to FIGS. 1 and 5, the gate driving circuit 100 outputs n gate signals GS1 to GSn to n gate lines GL1 to GLn, respectively.

As shown in FIG. 5, the gate driving circuit 100 includes a plurality of driving stages SRC1 to SRCn connected to each other one after another.

The driving stages SRC1 to SRCn are respectively connected to the gate lines GL1 to GLn. The driving stages SRC1 to SRCn apply the gate signals to the gate lines GL1 to GLn, respectively.

The gate driving circuit 100 may further include dummy stages SRCd1 and SRCd2 connected to a last driving stage SRCn among the driving stages SRC1 to SRCn. Each of the dummy stages SRCd1 and SRCd2 is connected to a corresponding dummy gate line among the dummy gate lines GLd.

Each of the driving stages SRC1 to SRCn may include an output terminal OUT, a carry terminal CR, an input terminal IN, a first control terminal CT1, a second control terminal CT2, a clock terminal CK, a clock bar terminal CKB, a first voltage input terminal V1, and a second voltage input terminal V2.

The output terminal OUT of each of the driving stages SRC1 to SRCn is connected to a corresponding gate line of the gate lines GL1 to GLn. Each of the gate signals GS1 to GSn generated by the driving stages SRC1 to SRCn is applied to a corresponding gate line among the gate lines GL1 to GLn through the output terminal OUT.

The carry terminal CR of each of the driving stages SRC1 to SRCn is electrically connected to the input terminal IN of a next driving stage of the corresponding driving stage. For example, carry terminals CR of the driving stages SRC1, SRC2 and SRCn−1 are electrically connected to the input terminals IN of the driving stages SRC2, SRC3 and SRCn, respectively. The carry terminal CR of each of the driving stages SRC1 to SRCn outputs a corresponding carry signal among carry signals CRS1 to CRSn.

The input terminal IN of each of the driving stages SRC2 to SRCn receives the carry signal from a previous driving stage of the corresponding driving stage. For instance, the input terminal IN of a third driving stage SRC3 receives the carry signal CRS2 output from a second driving stage SRC2. However, the input terminal IN of a first driving stage SRC1 may receive a start signal STV that starts an operation of the gate driving circuit 100 instead of the carry signal output from the previous driving stage.

The first control terminal CT1 of each of the driving stages SRC1 to SRCn may be electrically connected to the carry terminal CR of the next driving stage of the corresponding driving stage. The first control terminal CT1 of each of the driving stages SRC1 to SRCn receives the carry signal output from the next driving stage of the corresponding driving stage. For instance, the first control terminal CT1 of the second driving stage SRC2 receives the carry signal CRS3 output from the carry terminal CR of the third driving stage SRC3. According to another exemplary embodiment, the first control terminal CT1 of each of the driving stages SRC1 to SRCn may be electrically connected to the output terminal OUT of the next driving stage of the corresponding driving stage rather than the carry terminal CR of the next driving stage.

The first control terminal CT1 of the last driving stage SRCn may receive the carry signal CRSd1 output from the carry terminal CR of the first dummy stage SRCd1. The first control terminal CT1 of the first dummy stage SRCd1 may receive the carry signal CRSd2 output from the carry terminal CR of the second dummy stage SRCd2.

The second control terminal CT2 of each of the driving stages SRC1 to SRCn may be electrically connected to the carry terminal CR of the driving stage after the next driving stage of the corresponding driving stage. The second control terminal CT2 of each of the driving stages SRC1 to SRCn may receive the carry signal output from the driving stage after the next driving stage of the corresponding driving stage. For instance, the second control terminal CT2 of the first driving stage SRC1 receives the carry signal CRS3 output from the carry terminal CR of the third driving stage SRC3.

The clock terminal CK of each of the driving stages SRC1 to SRCn receives a first clock signal CK1. The clock bar terminal CKB of each of the driving stages SRC1 to SRCn receives a first clock bar signal CKB1. The first clock signal CK1 and the first clock bar signal CKB1 have a phase difference of about 180 degrees.

The first voltage input terminal V1 of each of the driving stages SRC1 to SRCn receives a first low voltage VSS1, and the second voltage input terminal V2 of each of the driving stages SRC1 to SRCn receives a second low voltage VSS2. The second low voltage VSS2 has a voltage level less than that of the first low voltage VSS1. For instance, the level of the first low voltage VSS1 may be within a range from about −15 volts to about −5 volts and may gradually decrease or increase without being fixed. The level of the first low voltage VSS1 will be described in detail with reference to FIGS. 7 to 9B.

The level of the second low voltage VSS2 may be within a range from about −35 volts to about −14 volts in the frame periods FR-O and FR-E. However, the levels of the first and second low voltages VSS1 and VSS2 according to the invention should not be limited thereto or thereby.

In each of the driving stages SRC1 to SRCn according to another exemplary embodiment, one of the output terminal OUT, the carry terminal CR, the input terminal IN, the first control terminal CT1, the second control terminal CT2, the clock terminal CK, the clock bar terminal CKB, the first voltage input terminal V1, and the second voltage input terminal V2 may be omitted, or another terminal may be added to each of the driving stages SRC1 to SRCn. For instance, one of the first and second voltage input terminals V1 and V2 may be omitted. In addition, a connection relation between the driving stages SRC1 to SRCn may be changed.

Figure 6:
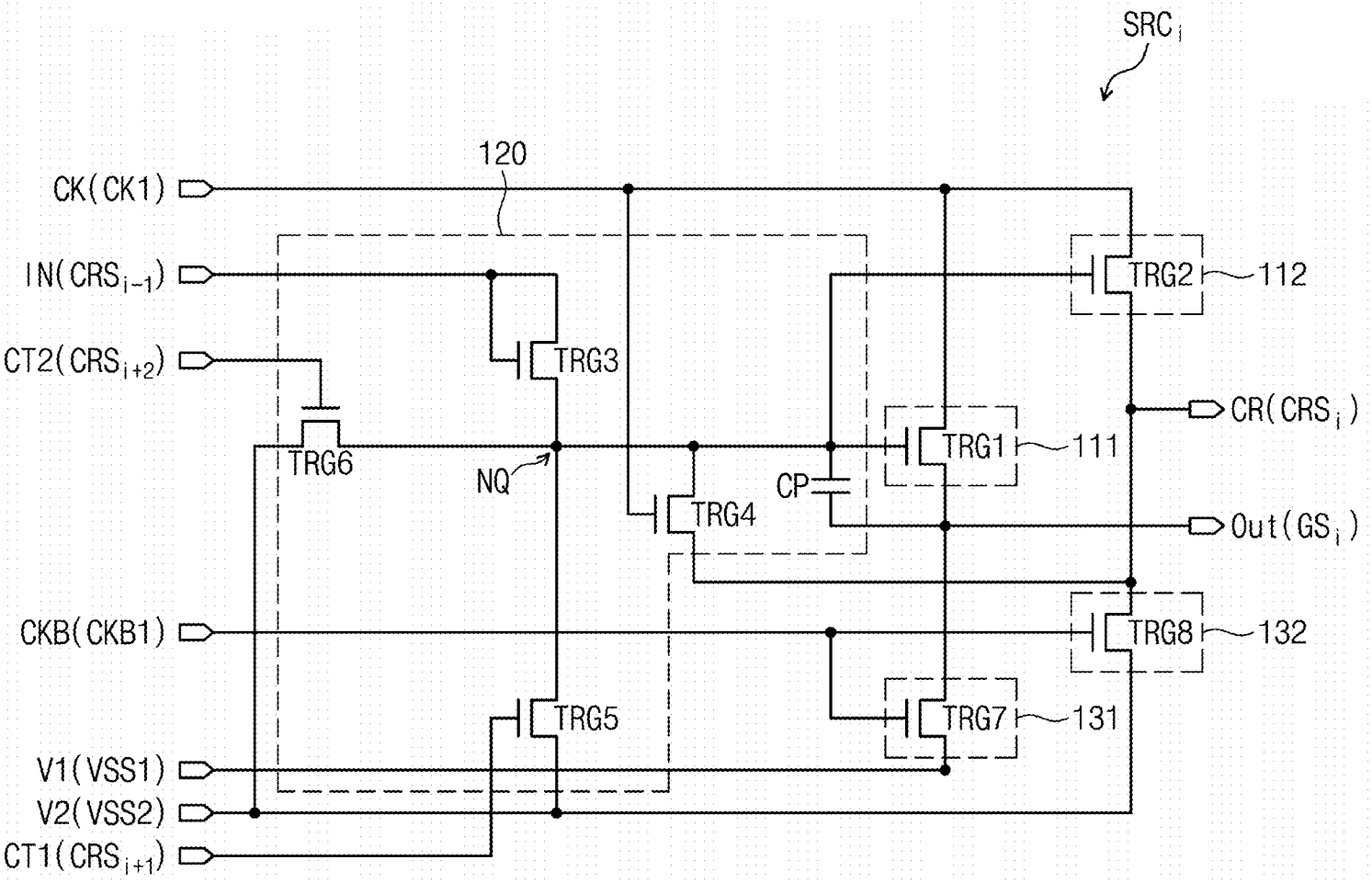
FIG. 6 is a circuit diagram showing an exemplary embodiment of an i-th driving stage among plural stages shown in FIG. 5.
Figure 7:
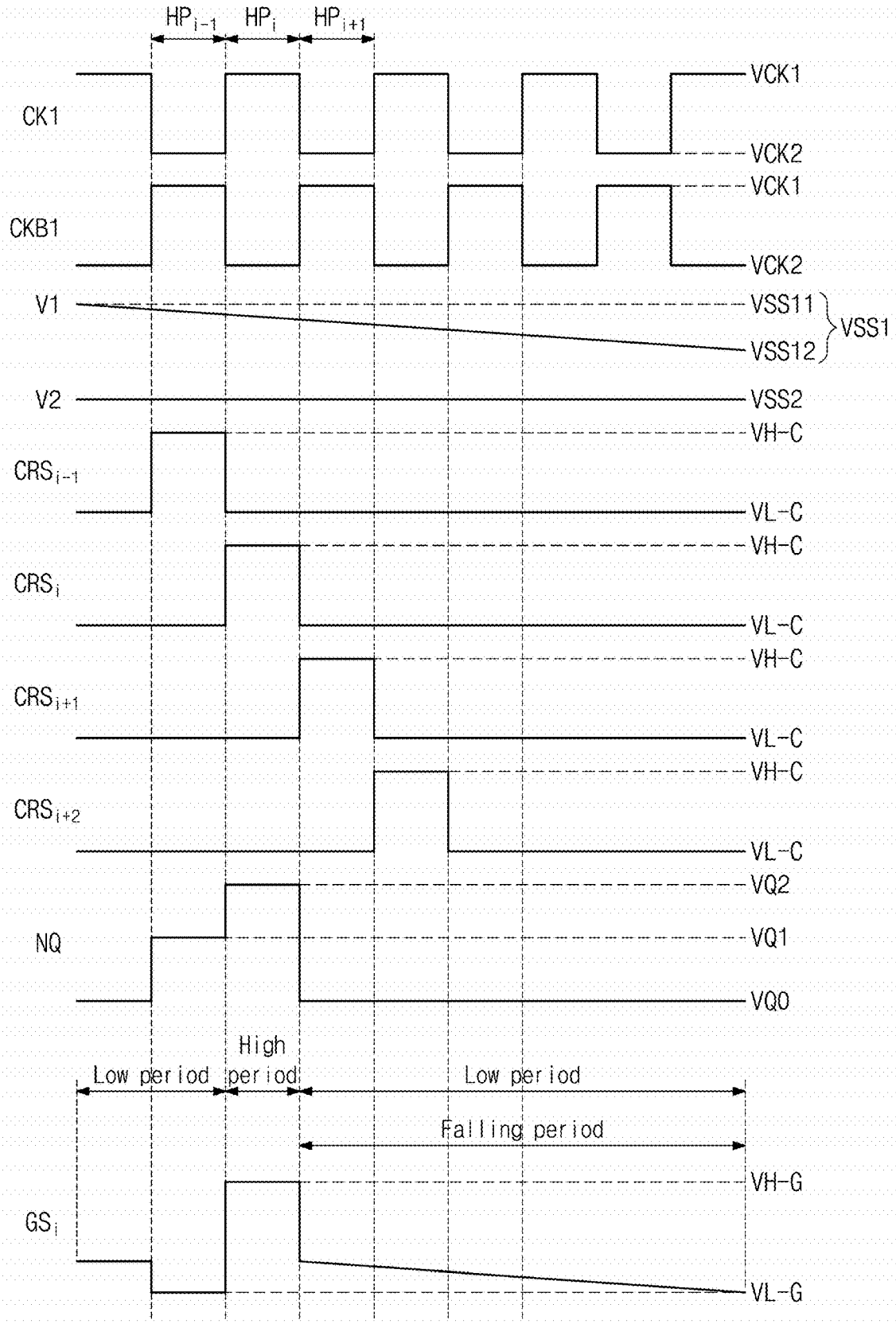
FIG. 7 is a waveform diagram showing an exemplary embodiment of input/output signals of the i-th driving stage shown in FIG. 6.

FIG. 6 is a circuit diagram showing an exemplary embodiment of an i-th driving stage $SRC_i$ among the driving stages SRC1 to SRCn shown in FIG. 5. FIG. 7 is a waveform diagram showing an exemplary embodiment of input/output signals of the i-th driving stage $SRC_i$ shown in FIG. 6. Each of the driving stages SRC1 to SRCn shown in FIG. 5 may have the same circuit configuration as that of the i-th driving stage $SRC_i$.

Referring to FIG. 6, the i-th driving stage $SRC_i$ includes output parts 111 and 112, a control part 120, and pull-down parts 131 and 132. The output parts 111 and 112 include a first output part 111 outputting an i-th gate signal $GS_i$ and a second output part 112 outputting an i-th carry signal $CRS_i$. The pull-down parts 131 and 132 include a first pull-down part 131 lowering the i-th gate signal $GS_i$ output from the output terminal OUT and a second pull-down part 132 lowering the i-th carry signal $CRS_i$ output from the carry terminal CR.

The i-th driving stage $SRC_i$ includes a plurality of driving transistors TRG1 to TRG8. The driving transistors TRG1 to TRG8 are classified into output transistors TRG1 and TRG2, control transistors TRG3, TRG4, TRG5, and TRG6, and pull-down transistors TRG7 and TRG8.

The circuit configuration of the i-th driving stage $SRC_i$ according to the invention should not be limited thereto or thereby.

The first output part 111 includes a first output transistor TRG1. The first output transistor TRG1 includes an input electrode receiving the first clock signal CK1, a control electrode connected to a Q-node NQ, and an output electrode outputting the i-th gate signal $GS_i$.

The second output part 112 includes a second output transistor TRG2. The second output transistor TRG2 includes an input electrode receiving the first clock signal CK1, a control electrode connected to the Q-node NQ, and an output electrode outputting the i-th carry signal $CRS_i$.

As shown in FIG. 7, each of the first clock signal CK1 and the first clock bar signal CKB1 swings between a first clock voltage VCK1 and a second clock voltage VCK2. The first clock voltage VCK1 may be within a range from about 15 volts to about 35 volts. The second clock voltage VCK2 may be within a range from about −35 volts to about −14 volts. The second clock voltage VCK2 may have the same level as that of the second low voltage VSS2.

A first input signal having the first low voltage VSS1 is applied to the first voltage input terminal V1, and a second input signal having the second low voltage VSS2 is applied to the second voltage input terminal V2.

The first input signal may include a period in which the first low voltage VSS1 falls to a second level VSS12 from a first level VSS11. The first level VSS11 may be equal to or greater than about −15 volts and equal to or smaller than about −5 volts, and the second level VSS12 may be equal to or greater than about −35 volts and equal to or smaller than about −14 volts. In an exemplary embodiment of the invention, the first input signal may further include a period in which the first low voltage VSS1 is constant. In another exemplary embodiment of the invention, the first input signal may further include a period in which the level of the first low voltage VSS1 rises.

On the other hand, the second low voltage VSS2 may have a constant level, but the invention should not be limited thereto or thereby. According to another exemplary embodiment, the level of the second low voltage VSS2 may be varied as the first low voltage VSS1.

The i-th gate signal $GS_i$ includes a gate-off signal having a relatively low voltage and a gate-on signal having a relatively high voltage. A period including the gate-off signal is defined as a low period, and a period including the gate-on signal is defined as a high period.

The gate-off signal may be generated by the first input signal applied to the output terminal OUT through the first pull-down part 131. Accordingly, a low voltage VL-G of the i-th gate signal $GS_i$ may have the same level as the first low voltage VSS1. The level of the low voltage VL-G may be within a range from about −15 volts to about −5 volts, and the level of the low voltage VL-G may gradually decrease or increase without being fixed to a certain value during the low period.

In the low period, a sub-period in which the level of the gate-off signal falls according to the first input signal is defined as a first period (hereinafter, referred to as "a falling period").

The i-th gate signal $GS_i$ may have the same level as the second clock voltage VCK2 of the first clock signal CK1 during a portion of period. The second clock voltage VCK2 of the first clock signal CK1 is output by the Q-node NQ that is pre-charged before the i-th gate signal $GS_i$ rises to a high voltage.

A high voltage VH-G of the i-th gate signal GSi may have the same level of the first clock voltage VCK1 of the first clock signal CK1.

The i-th carry signal CRSi includes a carry-off signal having a relatively low voltage VL-C and a carry-on signal having a relatively high voltage VH-C. Since the i-th carry signal $CRS_i$ is generated based on the first clock signal CK1, the i-th carry signal $CRS_i$ has the same/similar voltage level as the first clock signal CK1. The i−1-th, i+1-th, and i+2-th carry signals CRSi−1, CRSi+1 and CRSi+2 also include a carry-off signal having a relatively low voltage VL-C and a carry-on signal having a relatively high voltage VH-C.

The control part 120 may control an operation of the first and second output parts 111 and 112. The control part 120 turns on the first and second output parts 111 and 112 in response to an i−1-th carry signal $CRS_{i-1}$ output from an i−1-th driving stage $SRC_{i-1}$. The control part 120 may turn off the first and second output parts 111 and 112 in response to an i+1-th carry signal $CRS_{i+1}$ and an i+2-th carry signal $CRS_{i+2}$.

The control part 120 may include a first control transistor TRG3, a second control transistor TRG4, a third control transistor TRG5, a fourth control transistor TRG6, and a capacitor CP.

The first control transistor TRG3 applies a control signal to the Q-node NQ to control an electric potential of the Q-node NQ. FIG. 7 shows a horizontal period $HP_i$ (hereinafter, referred to as an "i-th horizontal period") in which the i-th gate signal $GS_i$ is output, a previous horizontal period $HP_{i-1}$ (hereinafter, referred to as an "i−1-th horizontal period"), and a next horizontal period $HP_{i+1}$ (hereinafter, referred to as an "i+1-th horizontal period").

The first control transistor TRG3 is connected between the input terminal IN and the Q-node NQ in a diode form such that a current flows only to the Q-node NQ from the input terminal IN. The first control transistor TRG3 includes a control electrode and an input electrode, which are commonly connected to the input terminal IN, and an output electrode connected to the Q-node NQ.

The capacitor CP is connected between the output electrode of the first output transistor TRG1 and the control electrode (or the Q-node NQ) of the first output transistor TRG1.

The second control transistor TRG4 applies the signal of the carry terminal CR to the Q-node NQ. The second control transistor TRG4 includes a control electrode connected to the clock terminal CK, an input electrode connected to the carry terminal CR, and an output electrode connected to the Q-node NQ.

The third control transistor TRG5 is connected between the second voltage input terminal V2 and the Q-node NQ. A control electrode of the third control transistor TRG5 is connected to the first control terminal CT1. The third control transistor TRG5 applies the second input signal having the second low voltage VSS2 to the Q-node NQ in response to the i+1-th carry signal $CRS_{i+1}$. According to another exemplary embodiment of the invention, the third control transistor TRG5 may be turned on by the i+1-th gate signal.

The fourth control transistor TRG6 is connected to between the second voltage input terminal V2 and the Q-node NQ. A control electrode of the fourth control transistor TRG6 is connected to the second control terminal CT2. The fourth control transistor TRG6 applies the second input signal having the second low voltage VSS2 to the Q-node NQ in response to the i+2-th carry signal $CRS_{i+2}$. According to another exemplary embodiment of the invention, the fourth control transistor TRG6 may be turned on by the i+2-th gate signal.

The configuration of the i-th driving stage $SRC_i$ according to the invention should not be limited to that shown in FIG. 6. In another exemplary embodiment, for instance, the i-th driving stage $SRC_i$ may further include an inverter part, and the clock bar terminal CKB may be omitted. In still another exemplary embodiment, one of the third control transistor TRG5 and the fourth control transistor TRG6 may be connected to the first voltage input terminal V1 without being connected to the second voltage input terminal V2.

As shown in FIG. 7, a voltage of the Q-node NQ rises to a first high voltage VQ1 by the i−1-th carry signal $CRS_{i-1}$ during the i−1-th horizontal period $HP_{i-1}$. When the i−1-th carry signal $CRS_{i-1}$ is applied to the Q-node NQ, the capacitor CP is charged with a voltage corresponding to the i−1-th carry signal $CRS_{i-1}$. The i-th gate signal $GS_i$ is output during the i-th horizontal period $HP_i$. In this case, the Q-node NQ is boosted to a second high voltage VQ2 from the first high voltage VQ1.

The voltage of the Q-node NQ is lowered to a Q-node base voltage VQ0 during the i+1-th horizontal period $HP_{i+1}$. Accordingly, the first and second output transistors TRG1 and TRG2 are turned off.

The first pull-down part 131 includes a first pull-down transistor TRG7. The first pull-down transistor TRG7 may include an input electrode connected to the first voltage input terminal V1, a control electrode connected to the clock bar terminal CKB, and an output electrode connected to the output electrode of the first output transistor TRG1. According to another exemplary embodiment, the input electrode of the first pull-down transistor TRG7 may be connected to the second voltage input terminal V2.

As shown in FIG. 7, the voltage of the i-th gate signal $GS_i$ after the i+1-th horizontal period $HP_{i+1}$ corresponds to the voltage of the output electrode of the first pull-down transistor TRG7. During the i+1-th horizontal period $HP_{i+1}$, the first pull-down transistor TRG7 applies the first low voltage VSS1 to the output electrode of the first output transistor TRG1 in response to the first clock bar signal CKB1.

The second pull-down part 132 may include a second pull-down transistor TRG8. The second pull-down transistor TRG8 includes an input electrode connected to the second voltage input terminal V2, a control electrode connected to the clock bar terminal CKB, and an output electrode connected to the output electrode of the second output transistor TRG2. According to another exemplary embodiment, the input electrode of the second pull-down transistor TRG8 may be connected to the first voltage input terminal V1.

As shown in FIG. 7, the voltage of the i-th carry signal $CRS_i$ after the i+1-th horizontal period $HP_{i+1}$ corresponds to the voltage of the output electrode of the second pull-down transistor TRG8. During the i+1-th horizontal period $HP_{i+1}$, the second pull-down transistor TRG8 applies the second input signal having the second low voltage VSS2 to the output electrode of the second output transistor TRG2 in response to the i+1-th carry signal.

FIGS. 8A to 8D are waveform diagrams showing exemplary embodiments of the gate signal GSi according to the invention.

Figure 8A:
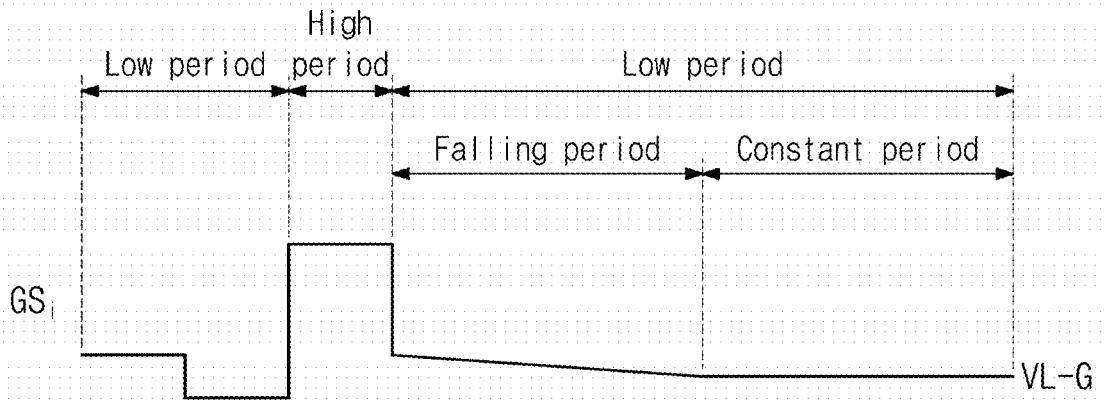
FIGS. 8A to 8D are waveform diagrams showing exemplary embodiments of a gate signal according to the invention.

Referring to FIG. 8A, the low period may include the falling period and a constant period existing after the falling period. The constant period corresponds to a period in which the level of the low voltage VL-G of the gate signal GSi is constant. If the falling period is continuously maintained in the low period without the constant period, the display panel may not be operated normally since the level of the low voltage VL-G becomes too low. Accordingly, by operating the constant period, when the level of the low voltage VL-G reaches a certain value, the level of the low voltage VL-G is maintained at the constant value without falling.

Figure 8B:
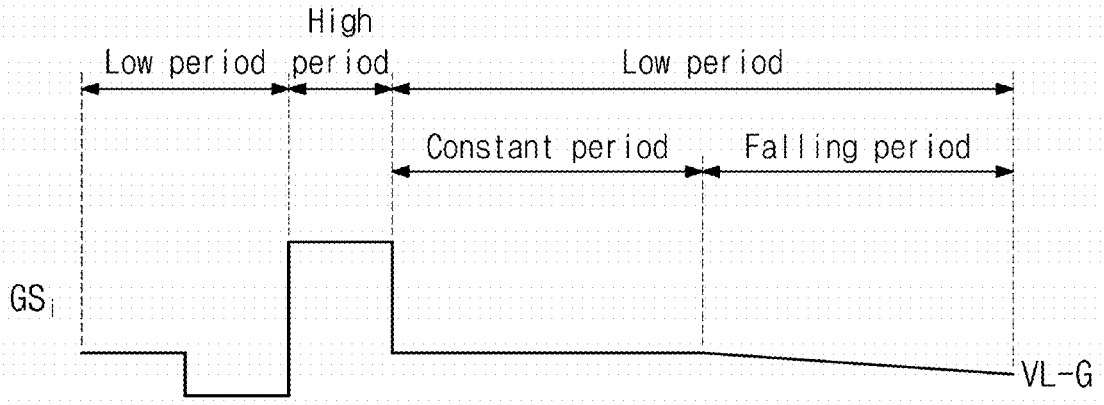

Referring to FIG. 8B, the low period may include the falling period and the constant period existing before the falling period. According to exemplary embodiments of the invention, the falling period may be unnecessary at an initial portion of the low period. Accordingly, the falling period may appear after the constant period is maintained at the initial portion of the low period.

Figure 8C:
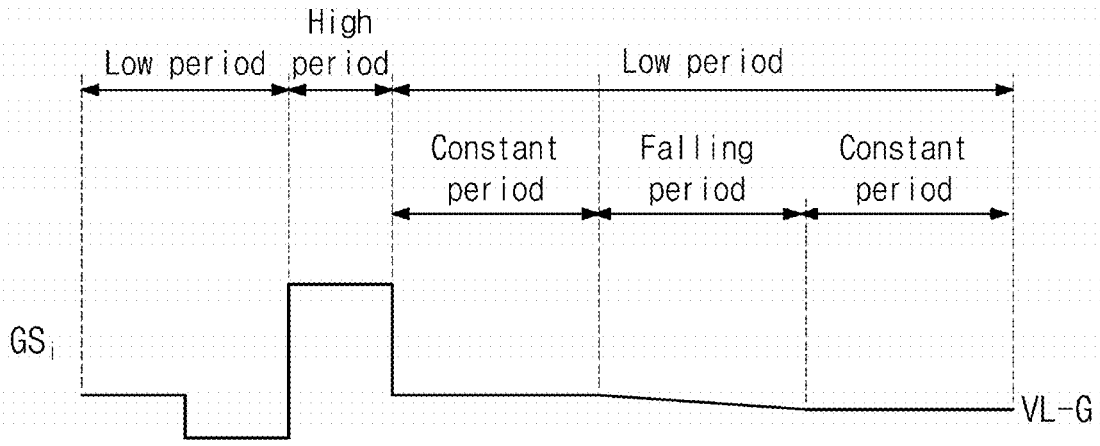

Referring to FIG. 8C, the low period may include the constant period, the falling period, and the constant period in that order. The exemplary embodiment shown in FIG. 8C may have the same effects as the exemplary embodiment shown in FIG. 8A or the exemplary embodiment shown in FIG. 8B.

Figure 8D:
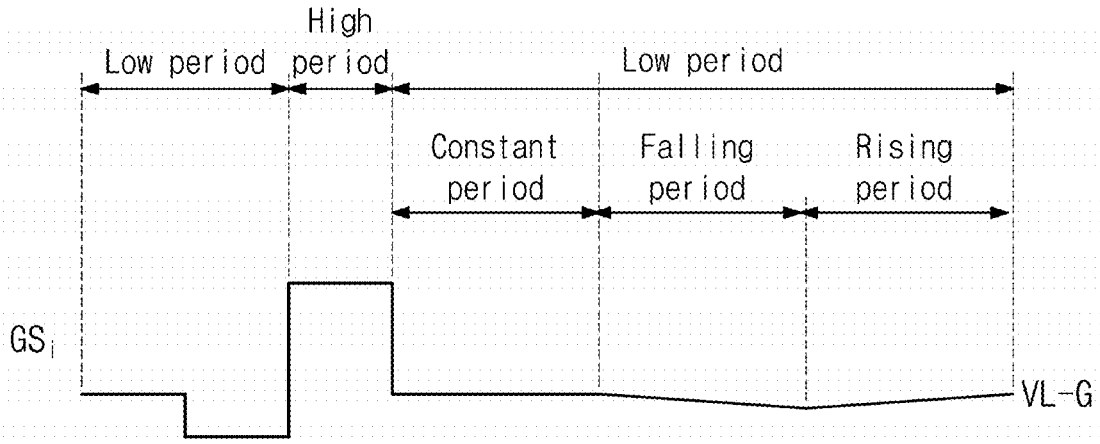

Referring to FIG. 8D, the low period may further include a second period (hereinafter, referred to as "a rising period"). The rising period corresponds to a period in which the level of the low voltage VL-G gradually rises. In the case that a driving characteristic of the pixel transistor TRP (refer to FIG. 3) varies due to the continuation of the falling period, the variation in the driving characteristic of the pixel transistor TRP may be corrected in the rising period.

Figure 9:
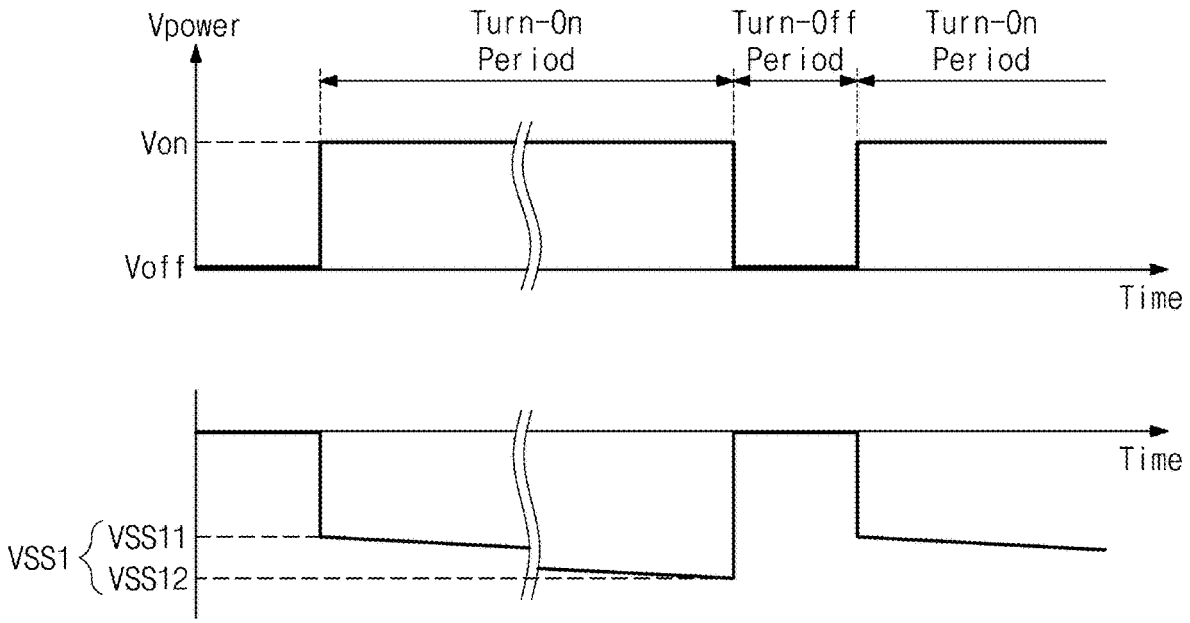
FIG. 9 is a waveform diagram showing a variation of a first low voltage according to an exemplary embodiment of the invention.

FIG. 9 is a waveform diagram showing an exemplary embodiment of a variation of the first low voltage VSS1 according to the invention. The display device DD (refer to FIG. 1) includes a turn-on period in which the display device DD is turned on in response to a power provided from the outside and displays an image and a turn-off period in which the display device DD is turned off since the power to the display device DD is blocked. A level of a power voltage Vpower in the turn-on period is Von which is greater than Voff, the level of the power voltage Vpower in the turn-off period.

In the turn-on period, the first low voltage VSS1 may gradually decrease to the second level VSS12 from the first level VSS11.

When the turn-off period starts after the turn-on period is finished, the level of the first low voltage VSS1 is initialized.

When the turn-on period starts after the turn-off period is finished, the first low voltage VSS1 may gradually decrease to the second level VSS12 from the first level VSS11 again.

Figure 10A:
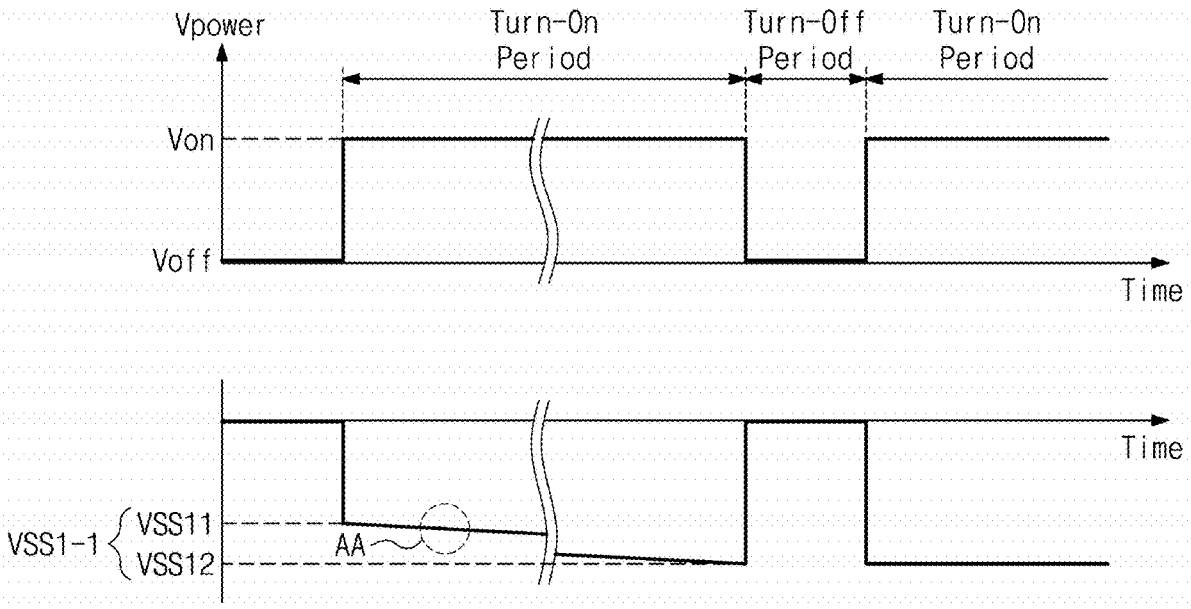
FIG. 10A is a waveform diagram showing an exemplary embodiment of a variation of a first low voltage according to the invention.
Figure 10B:
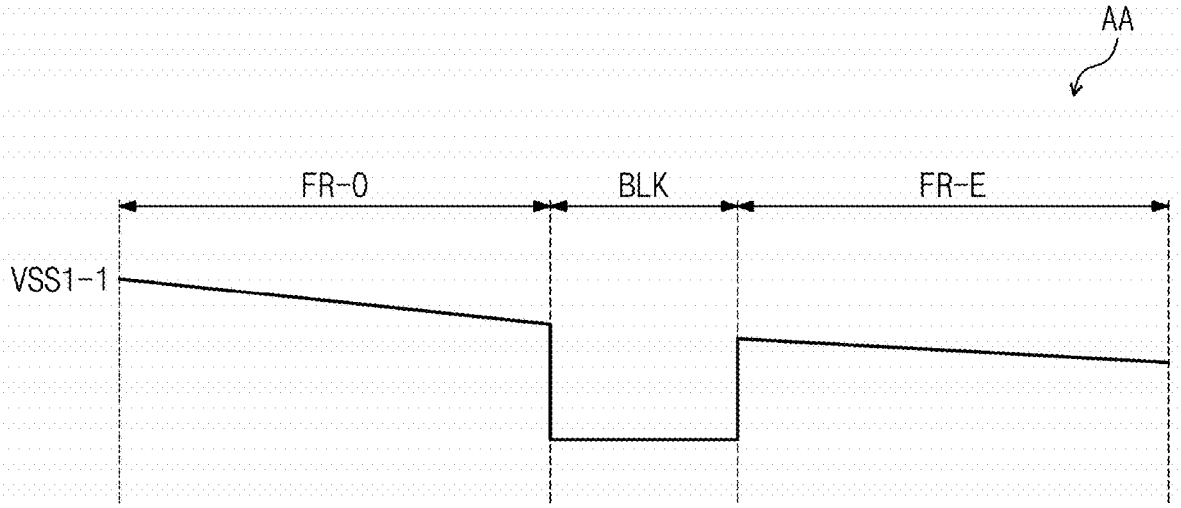
FIG. 10B is an enlarged view showing a portion AA of FIG. 10A.

FIG. 10A is a waveform diagram showing an exemplary embodiment of a variation of a first low voltage VSS1-1 according to the invention. FIG. 10B is an enlarged view showing a portion AA of FIG. 10A.

Referring to FIGS. 10A and 10B, different from the first low voltage VSS1 shown in FIG. 9, the level of the first low voltage VSS1-1 may not gradually decrease in the turn-on period.

During the frame periods FR-O and FR-E, the level of the first low voltage VSS1-1 may gradually decrease. The level of the first low voltage VSS1-1 of the blank period BLK may be less than the level of the first low voltage VSS1-1 of the frame periods FR-O and FR-E.

Information on image displayed through the display device DD (refer to FIG. 1) does not exist in the blank period BLK. Accordingly, although the level of the first low voltage VSS1-1 during the blank period BLK is less than the level of the first low voltage VSS1-1 during the frame periods FR-O and FR-E, influences on image quality may be small.

Figure 11A:
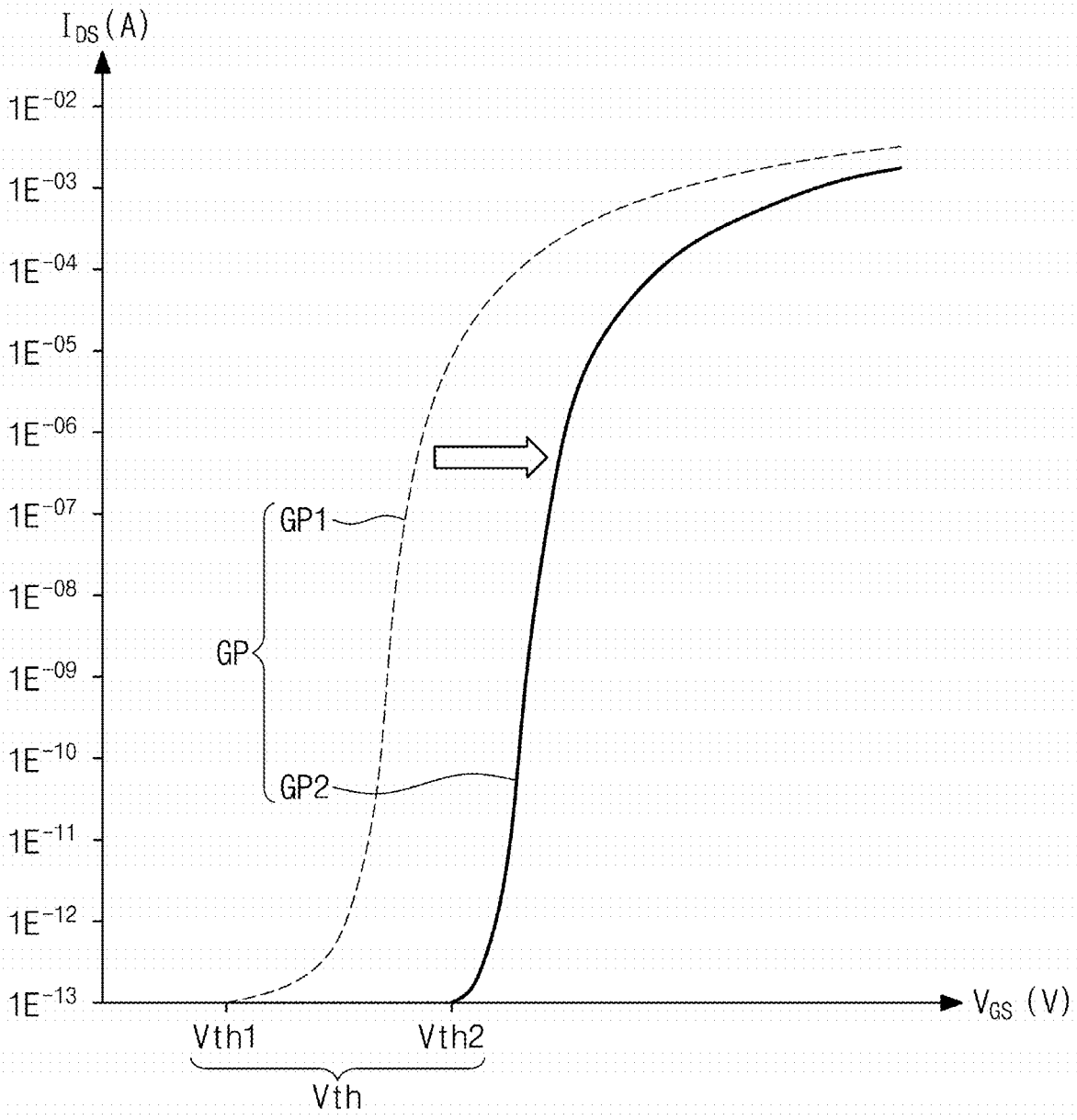
FIGS. 11A and 11B are graphs of output current versus control voltage to show a variation of threshold voltage of a pixel transistor according to an exemplary embodiment of the invention.
Figure 11B:
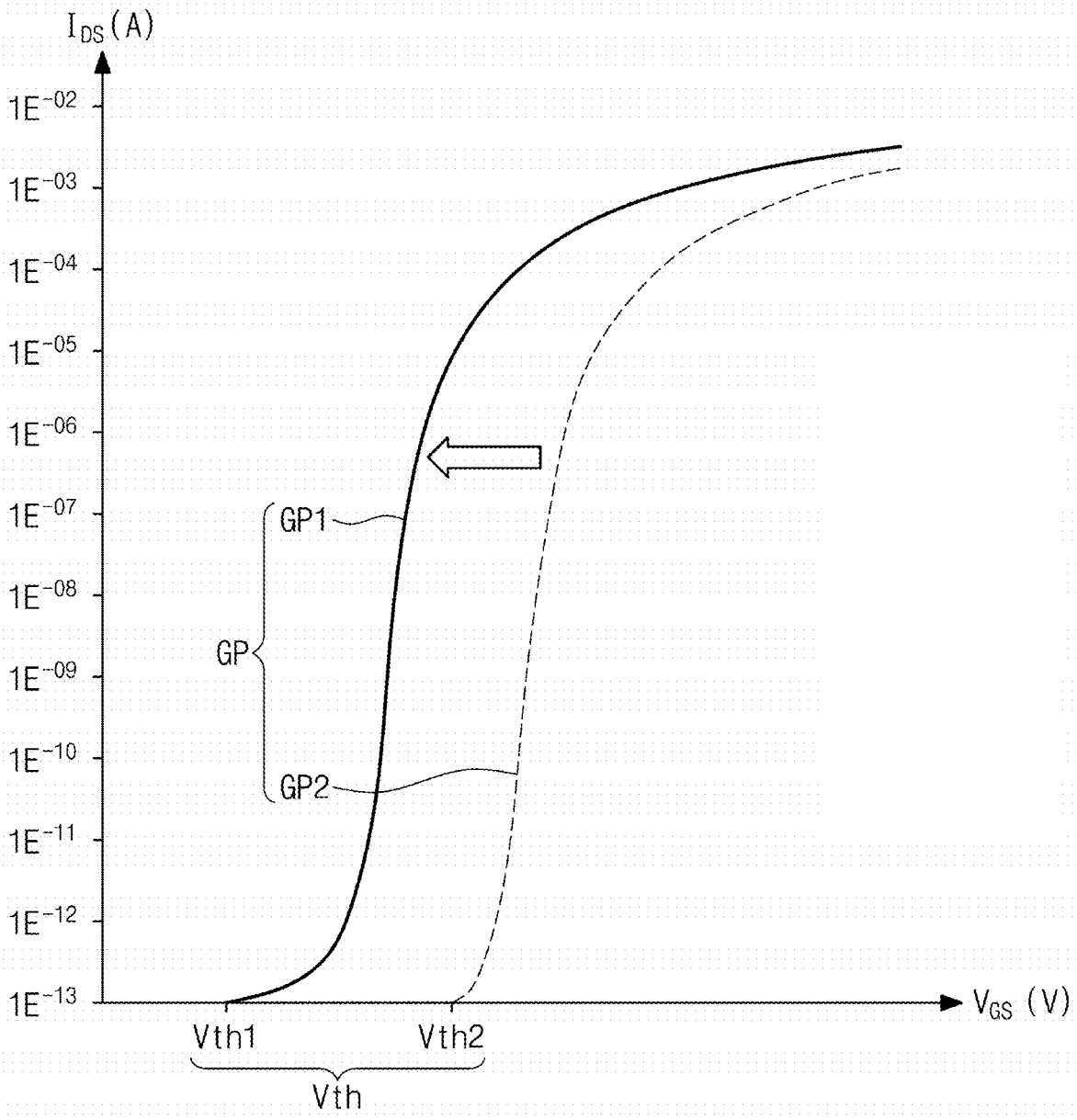

FIGS. 11A and 11B are graphs GP of current $I_{DS}$ (ampere: A) of an output electrode versus voltage $V_{GS}$ (voltage: V) of a control electrode to show a variation of threshold voltage Vth of a pixel transistor TRP according to an exemplary embodiment of the invention.

As described above, the level of the low voltage VL-G of the gate signals GS1 to GSn may be within the range from about −15 volts to about −5 volts, and the level of the high voltage VH-G of the gate signals GS1 to GSn may be within the range from about 15 volts to about 35 volts.

Since an absolute value of the high voltage VH-G that is a positive voltage is greater than an absolute value of the low voltage VL-G that is a negative voltage, an average level of the voltages of the gate signals GS1 to GSn becomes a positive value.

Referring to FIGS. 4 and 11A, when the gate signal GSi is applied to the pixel control electrode CEP, electrons corresponding to carriers of the pixel active layer ALP are trapped in the insulating layer ILP by the gate-on signal GSi having the high positive voltage level. Accordingly, the pixel transistor TRP is burnt and deteriorated, and thus a threshold voltage Vth of the pixel transistor TRP increases. In the case that the threshold voltage Vth increases, the pixel transistors TRP may not be smoothly turned on or off, thereby leading to an error in charge and discharge operation of the pixel $PX_{ij}$ (refer to FIG. 3).

As the duration in which the display device DD is turned on increases, the burning and deteriorating phenomenon of the pixel transistor TRP becomes severe. Accordingly, it is needed to control the increase of the threshold voltage Vth according to the turn-on duration.

A first graph GP1 shows an output current $I_{DS}$ of an output electrode versus a control voltage $V_{GS}$ of a control electrode and a first threshold voltage Vth1 of the driving transistors TRG before the driving transistors TRG are burnt and deteriorated. A second current graph GP2 shows an output current $I_{DS}$ of an output electrode versus a control voltage $V_{GS}$ of a control electrode and a second threshold voltage Vth2 after the pixel transistors TRP are burnt and deteriorated.

Like an exemplary embodiment of the invention, in the case that the level of the low voltage VL-G of each of the gate signals GS1 to GSn decreases as times goes by, the deterioration of the pixel transistors TRP by the increase of the threshold voltage Vth may be compensated.

Referring to FIG. 11B, according to an exemplary embodiment of the invention, the electrons trapped in the insulating layer ILP are de-trapped, and thus the threshold voltage Vth of the pixel transistors TRP may be restored to the first threshold voltage Vth1 from the second threshold voltage Vth2.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

Therefore, the disclosed subject matter according to the invention should not be limited to any single exemplary embodiment described herein, and the scope of the inventive concept shall be determined according to the attached claims.

What is claimed is:

1. A display device comprising:

a display panel which comprises a plurality of gate lines and a plurality of pixels, each of the pixels being connected to a corresponding gate line among the gate lines; and a gate driving circuit which comprises a stage that applies a gate signal to at least one of the gate lines, wherein the gate signal comprises a high period in which the gate signal has a high voltage and a low period in which the gate signal has a low voltage having a level less than a level of the high voltage, and the low period comprises a first period in which the low voltage falls to a second level from a first level which is greater than the second level, wherein, in a case that the gate driving circuit and the display panel are turned on after being turned off, the low voltage falls to the second level from the first level again.

2. The display device of claim 1, wherein each of the pixels comprises:

a pixel transistor which outputs a pixel voltage in response to the gate signal; and a liquid crystal capacitor charged with the pixel voltage.

3. The display device of claim 2, wherein the pixel transistor comprises:

a control electrode to which the gate signal is applied;

an insulating layer which covers the control electrode;

an active layer disposed on the insulating layer;

an input electrode to which a voltage corresponding to the pixel voltage is applied, the input electrode being disposed on the active layer; and an output electrode from which the pixel voltage is output, the output electrode being disposed on the active layer, wherein electrons trapped in the insulating layer are de-trapped in the first period.

4. The display device of claim 2, wherein the low voltage is continuously lowered in the first period.

5. The display device of claim 2, wherein the display panel displays an effective image during frame periods and displays a blank image during a blank period defined between the frame periods, and the level of the low voltage in the blank period is less than the level of the low voltage in the frame periods.

6. The display device of claim 1, wherein the first level is from about −15 volts to about −5 volts, and the second level is from about −35 volts to about −14 volts.

7. The display device of claim 6, wherein the high voltage is from about 14 volts to about 35 volts.

8. The display device of claim 1, wherein the stage comprises:

an output part which is turned on or off in response to a voltage of a Q-node and outputs the gate signal to a gate output terminal of the stage;

a control part which controls the voltage of the Q-node; and a pull-down part which applies the low voltage to the gate output terminal after the high period.

9. The display device of claim 1, wherein the low period further comprises a constant period in which the level of the low voltage is constant.

10. The display device of claim 1, wherein the low period further comprises a second period in which the level of the low voltage gradually rises.

11. A gate driving circuit comprising:

a gate output terminal electrically connected to a gate line;

a control part which controls a voltage of a Q-node;

a first output part which is turned on or off in response to the voltage of the Q-node and outputs a gate-on signal to the gate output terminal; and a first pull-down part which applies a gate-off signal, which comprises a period in which a voltage decreases to a second level from a first level which is greater than the second level, to the gate output terminal after the gate-on signal is output from the first output part, wherein, in a case that the gate driving circuit is turned on after being turned off, the voltage at the gate output terminal falls to the second level from the first level again.

12. The gate driving circuit of claim 11, further comprising:

a carry output terminal; and a second output part which is turned on or off in response to the voltage of the Q-node and outputs a carry-on signal to the carry output terminal.

13. The gate driving circuit of claim 12, further comprising a second pull-down part which applies a carry-off signal to the carry output terminal after the carry-on signal is output from the second output part.

14. The gate driving circuit of claim 13, wherein the carry-off signal has a voltage less than a voltage of the gate-off signal.

15. The gate driving circuit of claim 11, wherein the first level is from about −15 volts to about −5 volts, and the second level is from about −35 volts to about −14 volts.

16. A display device comprising:

a display panel which comprises a plurality of gate lines, a plurality of data lines, and a plurality of pixels, each of the pixels being connected to a corresponding gate line among the gate lines and a corresponding data line among the data lines;

a data driving circuit which applies a data signal to at least one of the data lines; and a gate driving circuit which applies a gate signal to at least one of the gate lines, the gate driving circuit comprising:

a gate output terminal electrically connected to one of the gate lines;

a control part which controls a voltage of a Q-node;

a first output part which is turned on or off in response to the voltage of the Q-node and outputs a gate-on signal to the gate output terminal; and a first pull-down part which applies a gate-off signal, in which a voltage decreases to a second level from a first level which is greater than the second level, to the gate output terminal after the gate-on signal is output from the first output part, wherein, in a case that the gate driving circuit and the display panel are turned on after being turned off, the voltage at the gate output terminal falls to the second level from the first level again.

17. The display device of claim 16, wherein the gate driving circuit comprises:

a carry output terminal; and a second output part which is turned on or off in response to the voltage of the Q-node and outputs a carry-on signal to the carry output terminal.

18. The display device of claim 17, wherein the gate driving circuit further comprises a second pull-down part which applies a carry-off signal to the carry output terminal after the carry-on signal is output from the second output part.

* * * * *